United States Patent [19]

Crowle

[11] Patent Number: 4,912,950

[45] Date of Patent: Apr. 3, 1990

[54] LOCKABLE BUCKLE

[75] Inventor: William G. Crowle, Deerfield, Ill.

[73] Assignee: Illinois Tool Works, Inc., Chicago, Ill.

[21] Appl. No.: 252,149

[22] Filed: Oct. 3, 1988

[51] Int. Cl.[4] ..... E05C 19/06

[52] U.S. Cl. ..... 70/58; 24/167; 24/614; 24/625; 292/89; 292/91; 292/210; 292/325; 292/DIG. 38

[58] Field of Search ..... 70/57, 57.1, 58; 24/625, 614, 615, 166, 167; 292/DIG. 38, 325, 19, 91, 210, 31, 108, 54, 89

[56] References Cited

U.S. PATENT DOCUMENTS

| | | | |
|---|---|---|---|
| 257,780 | 5/1882 | Stith | 24/615 X |
| 326,331 | 9/1885 | Ripson et al. | 292/19 |
| 1,139,316 | 5/1915 | Van Valkenburgh | 292/19 |
| 1,665,303 | 4/1928 | Hunter | 292/31 |
| 2,664,734 | 1/1954 | McEneaney | 70/57 X |
| 2,940,291 | 6/1960 | Swanson | 292/31 X |
| 3,008,319 | 11/1961 | Cheney | 292/31 X |
| 4,150,464 | 4/1979 | Tracy | 24/615 X |
| 4,500,120 | 2/1985 | Ridgewell et al. | 292/83 X |
| 4,587,695 | 5/1986 | Jensen | 24/615 X |
| 4,603,829 | 8/1986 | Koike et al. | 70/58 X |
| 4,631,787 | 12/1986 | Kasai | 24/615 X |
| 4,662,040 | 5/1987 | Terrell et al. | 24/615 X |
| 4,712,280 | 12/1987 | Fildan | 24/615 X |

FOREIGN PATENT DOCUMENTS

| | | | |
|---|---|---|---|
| 987121 | 4/1976 | Canada | 70/58 |
| 0466126 | 5/1914 | France | 24/615 |
| 216163 | 2/1925 | United Kingdom | 292/19 |
| 437124 | 10/1935 | United Kingdom | 292/19 |
| 2133830 | 8/1984 | United Kingdom . | |

*Primary Examiner*—Lloyd A. Gall

*Attorney, Agent, or Firm*—Schwartz & Weinrieb

[57] ABSTRACT

A lockable buckle includes a body member, a latch member, and a rotary locking member. The body member includes a pair of locking side slots. The latch member includes a pair of resilient arms having raised tab portions thereon for releasably engaging the opposed locking side slots of the body member. The rotary locking member is disposed in the body member and is adapted for rotation therein between a first position and a second position. In the first position, the raised tab portions are permitted to bend inwardly so as to allow insertion or removal of the latch member from the body member. In the second position, the raised tab portions are prevented from bending inwardly, thereby inhibiting disengagement of the latching member from the body member.

17 Claims, 2 Drawing Sheets

LOCKABLE BUCKLE

FIELD OF THE INVENTION

This invention relates generally to fastener devices and more particularly, it relates to a lockable buckle formed of a buckle body member and a buckle latch member which are capable of being releasably interlocked together and includes a rotary locking means for preventing the releasable disengagement of the latch member from the body member.

BACKGROUND OF THE INVENTION

The present invention has applications to spas, hot tubs and the like wherein a spa cover or lid is used to cover the open end of the spa and the same are locked together so as to prevent unwanted tampering or invasion from unauthorized users, such as for example, small children. In such applications, the body member of the invention is securely mounted to the side of the spa and the latch member is fastened to one end of a spa cover strap. The other end of the strap is permanently attached to the spa cover. After the latch member and the body member are interlocked together, a key is used to rotate a rotary member 90° which prevents the separation or removal of the latch member from the body member.

It would be expedient to construct the lockable buckle from a relatively simple design having a minimal number of components so as to facilitate the manufacture and assembly thereof. Furthermore, it would be desirable to fabricate the components of the lockable buckle from a resilient plastic material which can be produced at reduced costs by insert injection molding techniques, but yet provides resistance to corrosion and has high reliability during use.

In U.S. Pat. No. 4,150,464 entitled "Buckle" which was issued to Richard J. Tracy on Apr. 24, 1979, and assigned to the same assignee as this application, there is disclosed a buckle which includes separable cooperating receptacle and clasp members. The receptacle member includes a pair of locking slots formed in opposing sides thereof. The clasp member includes a pair of resilient arms having locking tabs thereon for releasably engaging the locking slots of the receptacle member. However, this '474 patent does not teach or suggest rotary locking means like that of the present invention which prevents the releasable disengagement of the latch member from the body member.

OBJECTS OF THE INVENTION

Accordingly, it is a general object of the present invention to provide a lockable buckle which is relatively simple in construction and is formed of a relatively few number of components so as to facilitate the manufacture and assembly thereof.

It is an object of the present invention to provide a lockable buckle formed of a body member and a latch member which are capable of being releasably interlocked together and includes a rotary member for preventing the releasable disengagement of the latch member from the body member.

It is another object of the present invention to provide a lockable buckle which includes a rotary member and a key for rotating the rotary member 90° so as to prevent removal of the latch member from the body member.

It is still another object of the present invention to provide a lockable buckle formed of a resilient plastic material so as to be resistant to corrosion, but yet has a high reliability during use.

SUMMARY OF THE INVENTION

In accordance with these aims and objectives, the present invention is concerned with the provision of a lockable buckle which includes a body member, a latch member, and a rotary member. The body member includes a pair of locking tabs, and the latch member includes a pair of resilient arms having raised tab portions for releasably engaging the locking slots of the body member. The rotary member is disposed within the body member and is adapted for rotation between a first position and a second position. In the first position, the raised tab portions are permitted to bend inwardly for insertion or removal of the latch member from the body member. In the second position, the raised tab portions are prevented from bending inwardly, thereby inhibiting disengagement of the latch member from the body member.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the same, wherein.

DESCRIPTION OF THE PREFERRED EMBODIMENT

It is to be distinctly understood at the outset that the present invention shown in association with a spa and a spa cover is not intended to serve as a limitation upon the scope or teachings thereof, but is merely for the purpose of convenience of illustration of one example of its application. The present invention has numerous applications in other fields and apparatus since the invention pertains to a rotary locking member for preventing the releasable disengagement of a buckle latch member from a buckle body member.

Figure 12:
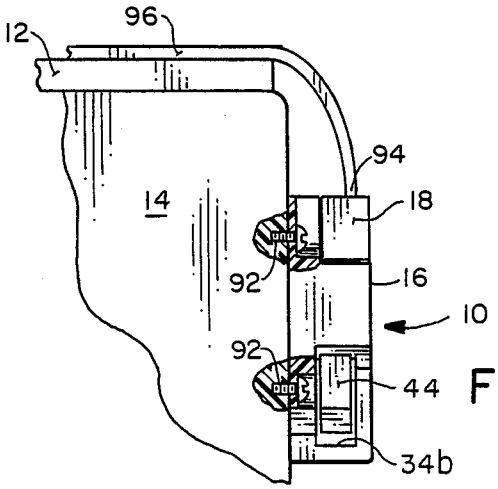
FIG. 12 is a partial view of a spa and spa cover, and depicts the lockable buckle of FIG. 1 mounted on the spa with its lockable member attached to the spa cover.

Referring now to the various views of the drawings, there is illustrated a lockable buckle 10 constructed in accordance with the principles of the present invention for securely locking together a spa cover 12 to a spa 14, as depicted in FIG. 12. The lockable buckle 10 includes a separate cooperating receptacle or body member 16, a latch member 18 adapted for receipt within the body member 16, a rotary locking member 20 disposed in the body member 16, and a key 22 for actuating the rotary member 20. The body member 16, latch member 18, rotary member 20 and key 22 are preferably all made from a resilient plastic material which can be formed by insert injection molding equipment. The body member 16 and the latch member 18 each include cooperating mating or intercoupling means for releasably interengaging the latch and body members. The rotary locking member 20 and the key 22 define locking means for preventing the releasable disengagement of the latch member 18 from the body member 16.

The body member r16 is comprised of a generally rectangular-shaped base section 24 and a T-shaped top section 26. The top section 26 is jointed to the base section 24 by means of a pair of opposed side walls 28*a*, 28*b*, and an end wall 30. The opposed side walls 28*a*, 28*b* define an end opening 32 therebetween which is located opposite the end wall 30 for receiving the latch member 18, as will be presently explained. The intercoupling means of the body member 16 includes a pair of opposed locking side slots 34*a*, 34*b* extending between the respective side walls 28*a*, 28*b* and the end wall 30. Furthermore, the T-shaped top section 26 includes an octagonally-shaped aperture 36 which facilitates accessibility to the rotary member 20, as will be presently explained.

The latch member 18 includes a pair of opposed resilient arms 38, 40 and an intermediate portion 42 for interconnecting the arms 38 and 40. The resilient arms extend outwardly from opposite ends of the intermediate portion 42. The arms 38, 40 are spaced apart a distance substantially equal to the size of the end opening 32 extending between the side walls 28*a*, 28*b* of the body member 16. At the leading edges of the arms 38 and 40, there are formed raised tab portions 43, 44 which are spaced apart a distance slightly greater than the size of the end opening 32. The raised tab portions 43, 44 include a pair of inwardly sloping surfaces 46, 48 whose leading edges are spaced apart a distance slightly less than the size of the end opening 32. Each of the arms 38 and 40 further includes a first shoulder 50 and a second shoulder 52 spaced apart from the first shoulder 50. The distance between the first and second shoulder is slightly greater than the width of the side walls 28*a*, 28*b*.

In accordance with the foregoing description, it can thus be seen that the latch member 18 may be readily inserted into the end opening 32 of the body member 16 wherein the leading edges of the sloping surfaces 46, 48 are slidingly engaged with the inside surfaces of the side walls 28*a*, 28*b*. The resilient arms 38 and 40 are caused to flex inwardly as the latch member 18 is moved in the direction of arrow A (FIG. 2) for insertion into the body member 16. Subsequently, as the first shoulders 50 are moved into the respective opposed locking side slots 34*a*, 34*b*, the resilient arms 38, 40 spring or snap back to their original positions so as to cause the raised tab portions 43, 44 to be releasably locked within the slots 34*a*, 34*b*. The respective side walls 28*a*, 28*b* are trapped between the corresponding first and second shoulders 50, 52 so as to prevent removal of, or motion of the latch member 18 either in the direction of the arrow A or in the direction opposite to arrow A.

Figure 4:
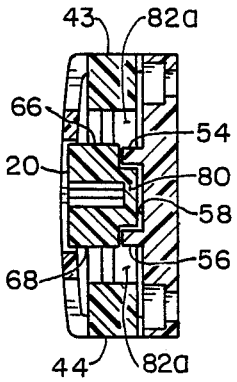
FIG. 4 is a cross-sectional view, taken along the lines 4—4 of FIG. 3.
Figure 7:
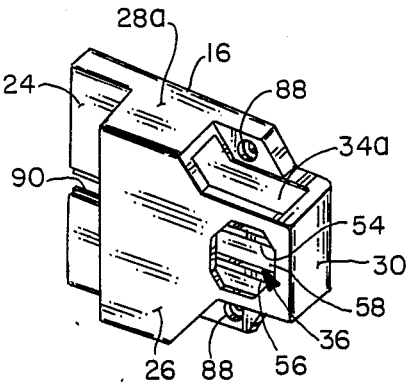
FIG. 7 is a perspective view of the body member of the lockable buckle of FIG. 2.

As can best seen from FIGS. 4 and 7, the base section 24 of the body member 16 includes a pair of opposed ridges 54, 56 which form a channel 58 therebetween. The ridges 54, 56 are formed midway between the side walls 28*a*, 28*b* and extend from the end wall 30 to the middle of the base section 24. As clearly depicted in FIG. 8, the intermediate portion 42 of the latch member 18 includes a pair of ridges 59*a*, 59*b* which extend laterally outwardly therefrom and which are spaced apart substantially the width of the channel 58. The ridges 59*a*, 59*b* are adapted for slidably engaging the channel 58 so as to facilitate alignment of the latch and body members. The rotary member 20 is of an octagonal configuration and is rotatably positioned between the channel 58 and the aperture 36 of the body member 16.

Figure 9:
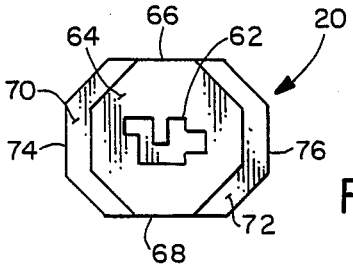
FIG. 9 is a top plan view of the rotary member of the lockable buckle of FIG. 1.
Figure 11:
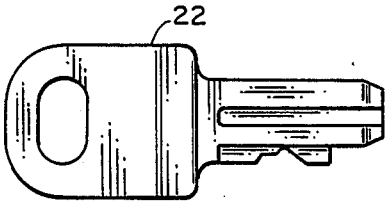
FIG. 11 is a front plan view of a key for actuating the rotary member of the lockable buckle of FIG. 1
Figure 10:
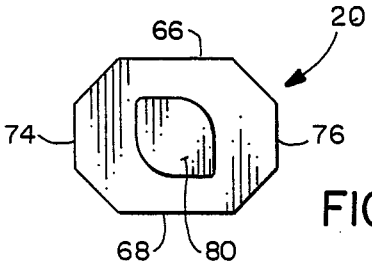
FIG. 10 is a bottom plan view of the rotary member of the lockable buckle of FIG. 1.

As best seen in FIG. 9 through 11, the rotary member 20 is formed of a raised central portion 64 having a first pair of opposed sides 66, 68 and a pair of opposed extensions 70, 72 disposed perpendicularly to the first pair of opposed sides. The opposed extensions 70, 72 are provided with a second pair of opposed sides 74, 76. It will be noted that the distance between the second opposed sides 74, 76 is somewhat greater than the distance between the first opposed sides 66, 68. The top surface of the raised central portion 64 has a uniquely-shaped keyhole 62 which is accessible through the aperture 36 for receiving the key 22. The key 22 (FIG. 11) has a contour which is in conformity with the keyhole 62 for receipt therein. The bottom surface of the rotary member 20 has a centrally located cam 80 which permits only 90° of rotation of the rotary member within the channel 58.

Figure 3:
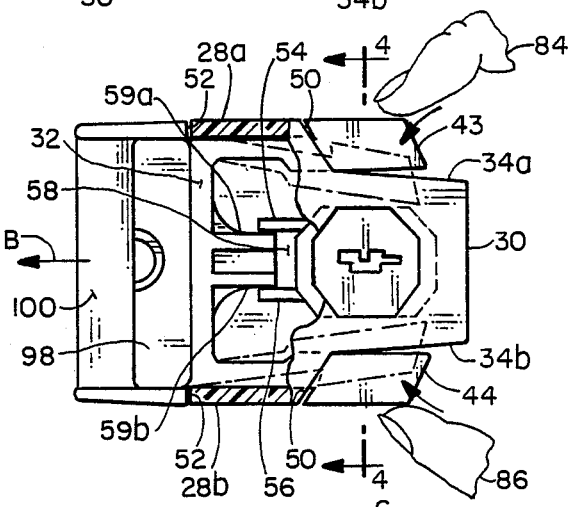
FIG. 3 is a front elevational view, partially cut away of the lockable buckle of FIG. 1, illustrating how the latch and body members may be disengaged.

As can be seen from FIGS. 3 and 4, when the rotary locking member 20 is in the unlocked position the first opposed sides 66, 68 are aligned with the inner surfaces of the respective raised tab portions 43, 44. It will be noted that gaps 82*a* are formed between the first opposed sides 66, 68 and the tab portions 43, 44. As a result, the tab portions 43, 44 of the resilient arms 38, 40 are permitted to bend inwardly to the extent necessary for insertion or removal of the latch member 18 with respect to the body member 16.

Figure 5:
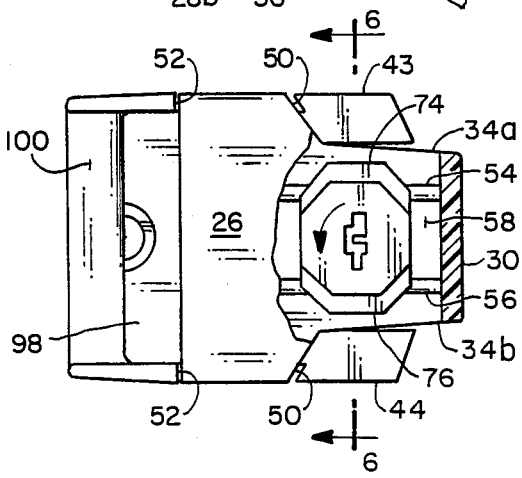
FIG. 5 is a front elevational view, partially cut away the lockable buckle of FIG. 1, illustrating how the latch and body members are interengaged and locked together.
Figure 6:
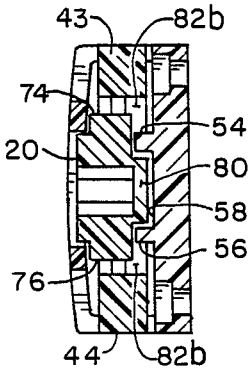
FIG. 6 is cross-sectional view, taken along the line 6—6 of FIG. 5.

As can be seen from FIGS. 5 and 6, the rotary locking member 20 has been rotated clockwise 90° from the unlocked position illustrated in FIGS. 3 and 4 to a locked position. This is accomplished by insertion of the key 22 into the keyhole 62 via the aperture 36 and then turning the same. Thus, the second opposed sides 74, 76 are now aligned with the inner surfaces of the raised tab portions 43, 44. Since the distance between the second opposed sides 74, 76 is of a greater distance than the distance between the first opposed sides 66, 68, the sizes of gaps 82*b* in FIG. 6 has been significantly reduced over the gaps 82*a* in FIG. 4. Consequently, the amount of inward bending of the tab portions 43, 44 necessary for the removal of the latch member from the body member has been reduced.

In view of the foregoing description and with particular reference to FIG. 3 of the drawings, the method of unlocking of the raised tab portions 43, 44 from the locking side slots 34*a*, 34*b* so as to permit disengagement or removal of the latch member 18 from the body member 16 will become apparent. As illustrated by the fingers 84, 86, the tab portions 43, 44 are squeezed together so as to cause them to move or bend inwardly so as to engage the first opposed sides 66, 68 of the rotary member 20. As a result, the distance between the tab portions is somewhat less than the distance between the side walls of the body member. Thus, the latch member may be readily removed from the body member by moving the same in the direction of arrow B.

Figure 1:
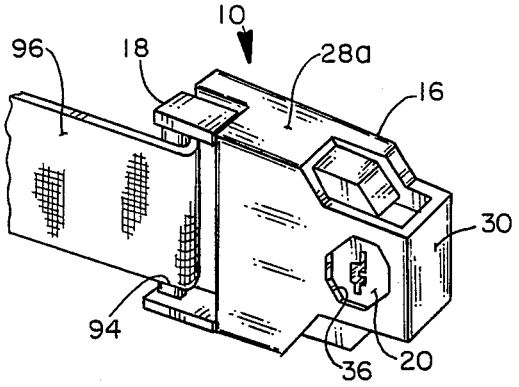
FIG. 1 is a perspective view of a lockable buckle constructed in accordance with the principles of the present invention, with the latch and body members being interengaged.
Figure 2:
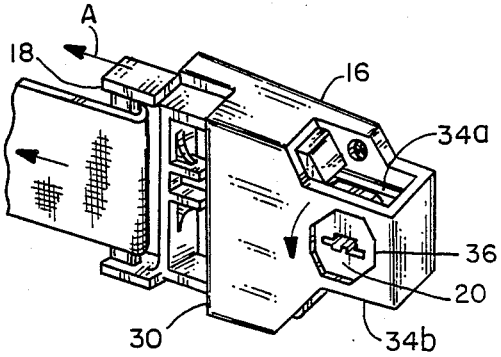
FIG. 2 is a perspective view of the lockable buckle of FIG. 1, with the latch and body members being disengaged.
Figure 8:
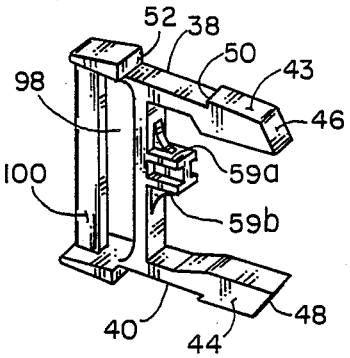
FIG. 8 is a perspective view of the latch member of the lockable buckle of FIG. 2.

Referring to FIG. 7 of the drawings, it will be noted that the body member includes mounting means for secure attachment to the side of the spa 14 of FIG. 1. The mounting means of the body member 16 includes a pair of opposed screw holes 88 and a screw slot 90 formed in the base section 24 of the body member 16 for receiving screws 92 (FIG. 12). Referring to FIGS. 1 and 8, the latch member 18 includes means for attachment to an end 94 of a spa cover strap 96. The cover strap attachment means of the latch member 18 includes an end portion 100 disposed in a spaced apart relationship with respect to the intermediate portion 42 so as to form an elongated slot 98 therebetween. The end 94 of the cover strap 96 may be looped through the slot 98 and around the end portion 100, as illustrated in FIGS. 1 and 2, and then sewn or otherwise attached to the cover strap 96 for permitting attachment to the latch member 18. The other end (not shown) of the spa cover strap is permanently secured to the spa cover 12.

From the foregoing detailed description, it can thus be seen that the present invention provides a lockable buckle for securely locking together a spa cover to a spa. The lockable buckle includes a body member, a latch member capable of being releasably interlocked with the body member, and a rotary locking member for preventing the releasable disengagement of the latch member from the body member. The rotary member includes a keyhole for receiving a key for rotating the same between an unlocked position and a locked position.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A lockable buckle, comprising:

body means including opposed locking slots;

latch means including a pair of resilient arms, each resilient arm having a raised tab portion for releasably engaging said opposed locking slots of said body means;

aperture means having a configuration defined by a plurality of substantially flat sidewall portions of said body means; and rotary locking means rotatably disposed within said body means between a first unlocked position and a second locked position and including a base portion having a predetermined width dimension and a predetermined length dimension which is greater than said predetermined width dimension, and a raised portion having a multi-sided configuration corresponding to said configuration of said aperture means defined within said body means so as to operatively cooperate with said aperture means in defining said first unlocked position and said second locked position such that when said rotary locking means is disposed at said first unlocked position, said base portion of said rotary locking means will have its width dimension interposed between said resilient arms of said latch means so as to permit disengagement of said tab portions of said latch means from said locking slots of said body means while when said rotary locking means is disposed at said second locked position, said base portion of said rotary locking means will have its length dimension interposed between said resilient arms of said latch means so as to prevent disengagement of said tab portions of said latch means for said locking slots of said body means.

2. A lockable buckle as claimed in claim 1, wherein said body means includes mounting means for secure attachment to a spa or the like and wherein said latch means includes means for attaching an end of a spa cover strap or the like thereto.

3. A lockable buckle as claimed in claim 2, wherein said mounting means for secure attachment to the spa comprises a pair of opposed screw holes and a screw slot formed in said body means.

4. A lockable buckle as claimed in claim 3, wherein said means for attaching the end of the spa cover strap comprises an end portion of said body means disposed in a spaced apart relationship to an intermediate portion of said body means to form an elongated slot therebetween for receiving the end of the spa cover strap.

5. A lockable buckle as claimed in claim 1, wherein said rotary locking means comprises a raised central portion having a first pair of opposed sides, and a pair of opposed extensions disposed perpendicularly to said first pair of opposed sides, said pair of opposed extensions having a second pair of opposed sides, the distance between said second pair of opposed sides being somewhat greater than the distance between said first pair of opposed sides.

6. A lockable buckle as claimed in claim 5, wherein said raised central portion of said rotary locking means has a keyhole formed in its top surface for receiving a key to rotate said rotary locking means 90° between the unlocked position and the locked position, said keyhole being accessible through said aperture means formed in a top section of said body means.

7. A lockable buckle as claimed in claim 6, wherein said rotary locking means has a bottom surface formed with a centrally located cam which permits only 90° of rotation of said rotary locking means within said body means.

8. A lockable buckle as set forth in claim 6, wherein:

said keyhole has an elongated configuration with the length dimension thereof aligned with said length dimension of said base portion of said rotary locking means such that said keyhole can visually indicate said locked and unlocked positions.

9. A lockable buckle as set forth in claim 1, wherein:

said configuration of said aperture means and said raised portion of said rotary locking means comprises an octagon.

10. A lockable buckle as set forth in claim 1, wherein:

said base portion of said rotary locking means has a substantially elongated octagonal configuration.

11. A lockable buckle comprising:

a body member;

a latch member;

said body member having a generally rectangular-shaped base section and a T-shaped top section, said top section being joined to said base section by a pair of opposed side walls and an end wall, said opposed side walls defining an end opening which is located opposite said end wall for receiving said latch member;

said body member further including a pair of opposed locking side slots extending between the respective side walls and the end wall;

said latch member including an intermediate portion and a pair of opposed resilient arms extending outwardly from opposite ends of said intermediate portion, each of said resilient arms including a raised tab portion for releasably engaging said locking slots of said body member;

said base section of said body member including a pair of opposed ridges for forming a channel therebetween, said opposed ridges being disposed between the opposed side walls and extending from the end wall to the middle of said base section;

said top section of said body member including an octagonally-shaped aperture;

an octagonally-shaped member being formed of a raised central portion having a first pair of opposed sides and a pair of opposed extensions disposed perpendicularly to said first pair of opposed sides, said pair of opposed extensions having a second pair of opposed sides, the distance between said second pair of opposed sides being somewhat greater than the distance between said first opposed sides; and said octagonally-shaped member being rotatably positioned between said channel and said aperture for rotation between an unlocked position in which the first pair of opposed sides are aligned with said raised tab portions for forming gaps therebetween so as to permit inward bending thereof for insertion or removal of the latch member from the body member and a locked position in which the second pair of opposed sides are aligned with said raised tab portions so as to prevent inward bending thereof and disengagement of the latch member from the body member.

12. A lockable buckle as claimed in claim 11, wherein said body member includes mounting means for secure attachment to a spa or the like and wherein said latch member includes means for attaching an end of a spa cover strap or the like thereto.

13. A lockable buckle as claimed in claim 12, wherein said mounting means for secure attachment to the spa comprises a pair of opposed screw holes and a screw slot formed in said base section of said body member.

14. A lockable buckle as claimed in claim 13, wherein said means for attaching the end of the spa cover strap comprises an end portion disposed in a spaced apart relationship to said intermediate portion to form an elongated slot therebetween for receiving the end of the spa cover strap.

15. A lockable buckle as claimed in claim 11, wherein said raised central portion of said octagonally-shaped member has a keyhole formed in its top surface for receiving a key to rotate said octagonally-shaped member 90° between the unlocked positioned and the locked position, said keyhole being accessible through said aperture formed in the top section of said body member.

16. A lockable buckle as claimed in claim 15, wherein said octagonally-shaped member has a bottom surface formed with a centrally located cam which permits only 90° of rotation of said octagonally-shaped member within said channel of said body member.

17. A lockable buckle as claimed in claim 11, wherein said intermediate portion of said latch member includes a pair of ridges extending laterally outwardly therefrom and spaced apart substantially the width of said channel of said body member for slidably engaging the channel to facilitate alignment of said latch and body members.

* * * * *